US006284108B1

(12) United States Patent
DiFrancesco

(10) Patent No.: US 6,284,108 B1
(45) Date of Patent: Sep. 4, 2001

(54) METHOD AND APPARATUS FOR MOMENTUM PLATING

(75) Inventor: Louis DiFrancesco, 31032 Hershey Way, Hayward, CA (US) 94544

(73) Assignee: Louis DiFrancesco, Hayward, CA (US)

( * ) Notice: Subject to any disclaimer, the term of this patent is extended or adjusted under 35 U.S.C. 154(b) by 0 days.

(21) Appl. No.: 09/130,502

(22) Filed: Aug. 31, 1998

(51) Int. Cl.[7] ..... C25D 17/00
(52) U.S. Cl. ..... 204/224 R
(58) Field of Search ..... 204/224 R; 205/133

(56) References Cited

U.S. PATENT DOCUMENTS

| | | | | |
|---|---|---|---|---|
| 2,854,387 | * | 9/1958 | Zimmerman et al. | 204/15 |
| 3,847,780 | * | 11/1974 | Burck | 204/224 R |
| 4,376,683 | * | 3/1983 | Hellwig et al. | 204/15 |
| 4,497,692 | | 2/1985 | Gelchinski et al. | 205/92 |
| 4,534,832 | * | 8/1985 | Doiron, Jr. | 204/15 |
| 4,804,132 | | 2/1989 | DiFrancesco | 228/115 |
| 5,083,697 | | 1/1992 | DiFrancesco | 228/116 |
| 5,641,391 | * | 6/1997 | Kobayashi | 205/80 |
| 5,670,251 | | 9/1997 | DiFrancesco | 428/325 |
| 5,830,334 | * | 11/1998 | Kobayashi | 204/224 R |
| 5,985,126 | * | 11/1999 | Bleck et al. | 205/123 |

OTHER PUBLICATIONS

Serfilco Co., Ltd., 1'997–1998 Catalog W p. 283, Free Agitation, "Efficient Agitation and Mixing Of: Cleaning/ Rinsing/ Plating/Waste Treatment and Other Process Solutions," URL=http://www.sergilco.com/scipts/gotoapge.eti., pp. 283–285. Month Not Available.

* cited by examiner

*Primary Examiner*—Kathryn Gorgos
*Assistant Examiner*—Erica Smith-Hicks
(74) *Attorney, Agent, or Firm*—Dergosits & Noah LLP

(57) ABSTRACT

A method and apparatus are provided for momentum plating. A nozzle directs a jet of a plating fluid to a workpiece surface, preferably oriented either below or lateral to the jet. The nozzle is formed surrounding an anode and the plating fluid passes either through or around the anode. The flow vector range of the jet impinges on the surface in a continuous fashion and without interruption at a region to be plated. Optionally, a first seal prevents the plating fluid from flowing across either a non-plated or a previously-plated area of the workpiece. The nozzle can be moved across the surface or, alternatively, the workpiece can be conveyed past a fixed nozzle. A patterned plated coating can be produced by varying the number and orientation of seals, the number of nozzles, the type of plating fluid, the angle of jet flow, and the rate and direction of the jet flow across the surface.

23 Claims, 4 Drawing Sheets

METHOD AND APPARATUS FOR MOMENTUM PLATING

TECHNICAL FIELD

The present invention relates generally to electrochemical plating. More specifically, the present invention is directed to a method and apparatus for increasing and controlling the flow of plating fluid to increase the rate of plating of a workpiece.

BACKGROUND OF THE INVENTION

Plating is the process of electrochemically depositing the layer onto a surface of a workpiece. In a typical plating process according to the prior art, a positively-charged element, the anode, is disposed in a plating fluid. A negatively-charged workpiece is also immersed in the fluid. The electric charge between the anode and the cathode creates ions in the plating fluid. These ions are then electrically attracted to the workpiece and are deposited on the surface.

The rate of ionic exchange at the surface of the workpiece can affect the quality of the plating. An increased ionic exchange rate can produce an improved plating grain structure. In addition, such increased ionic exchange rate promotes higher current densities. This results in faster plating and, therefore, a higher plating throughput.

A high ionic exchange rate can be promoted by continually refreshing the plating fluid at the surface of the workpiece. For example, a laminar fluid flow can be created by moving the plating fluid across the surface of the workpiece. However, a laminar fluid flow is relatively slow. The plating fluid is subject to the effects of friction at the surface of the workpiece. As this frictional force is increased, the plating fluid is slowed. At the molecular level, the plating fluid flow can be stopped. The ionic exchange rate is therefore decreased, and the plating process slowed. Thus, the ionic exchange rate produced by a laminar flow is limited.

It is well-known to use a turbulent plating fluid flow to provide a high ionic exchange rate. However, more energy is required to generate a turbulent fluid flow than a laminar flow. In addition, it is difficult to produce a uniform ionic exchange rate at each point on the surface by using a turbulent flow. Thus, a non-uniform coating will be formed over the surface. The maximum ionic exchange rate is therefore limited by the maximum amount of turbulent flow that permits the creation of a relatively uniform coating.

One prior art method for increasing turbulent flow is by circulating the plating fluid in the plating tank. FIG. 1 is a top plan view of a dip tank plating system according to the prior art. In the Figure, three parallel rows 12, 14, 16 of in-line anode baskets 18 are disposed in a plating tank 10. The plating tank holds a plating fluid (not shown). A cathodic workpiece 20, 22 is immersed in the plating fluid, between the rows of anode baskets.

Spargers 24, 26, 28 are located, for example, at the bottom of the tank, such that spargers are positioned on both sides of the workpiece. The spargers release air bubbles to agitate the plating fluid. The resulting agitation can improve the plating efficiency of the system. However, one known problem with such system is that the air bubbles lower the density of the plating fluid. Each air bubble displaces the conductive plating fluid with an insulative air bubble. Furthermore, air bubbles can also increase the evaporation of the plating fluid. Thus, the rate and amount of air bubbles introduced into the tank must be balanced by the lowered density of plating fluid caused thereby Another problem inherent to the dip tank system is that air bubbles can adhere to the surface of the workpiece during plating. An adhering air bubble can then detach from the surface, leaving a recessed portion in the plated surface of the workpiece. To produce a consistent, and even plating, it is important to constantly detach adhering air bubbles from the workpiece surface. The maximum plating efficiency of the prior art dip tank system is therefore limited by the ability of the system to detach adhering bubbles from the workpiece surface. Under ideal conditions, the prior dip tank can achieve a plating current density of approximately 10–150 amperes per square foot, with a typical plating current density of between 10–30 amperes per square foot.

The circulation plating system attempts to solve these recognized problems of dip tank plating systems. FIG. 2 is a side sectional view of a circulation plating system 38 according to the prior art. Such circulation plating systems include the SER-DUCTOR™ Systems developed by Serfilco Ltd. of Northbrook, Ill.

In FIG. 2, a centrifugal pump (not shown) draws plating fluid 36 from a plating tank 34 and delivers this plating fluid back into the tank through a plurality of nozzles 32. The plating fluid is thereby circulated within the plating tank.

However, one problem with a circulation plating system is achieving a constant circulation of plating fluid directed at all locations on a surface 31 of the workpiece 30. Differing rates of circulation result in different ionic exchange rates across the surface, producing an uneven coating. For example, the plating fluid circulation 35 dispersed by the different nozzles could result in locations on the surface at which the ionic density is significantly greater, or significantly less than other locations. This is a significant disadvantage in plating devices that require extreme precision.

In the Serfilco system, the nozzles are generally not directed at the surface of the workpiece. Directing an inadequate amount of nozzles at the workpiece surface promotes an unequal distribution of ions at the surface. Thus, the plating current density is limited by the circulation rate which can be achieved by nozzles directed away from the workpiece surface. The Serfilco circulation plating system can achieve plating current densities that are as high as 2 times, and typically from 1.25 to 1.5 times greater than those achieved using a dip tank system.

The use of a plating fluid flow to achieve a higher ionic exchange rate is also known in the prior art. An example of such flow process is the fountain plating process of the International Business Machines Corporation (IBM) of Armonk, N.Y. FIG. 3 is a side view of a portion of a fountain plating apparatus 44 according to the prior art.

In the fountain plating process, a vertical nozzle 46 directs a fountain of plating fluid 48 up towards the rotating workpiece 50. The plating fluid contacts the surface 52 of the workpiece at a velocity sufficient to promote an increased ionic exchange. A plurality (not shown) of these fountains are used in the fountain plating system.

However, the vertical fluid stream used in the fountain plating process is subject to the effects of gravity. Gravity attracts the fluid stream, pulling the fluid downwards. Thus, the stream curves as it approaches the surface of the workpiece. This curvature of the fluid stream can result in a "dead spot" 54 at which there is a reduced fluid flow contacting the surface. The resulting unequal ionic distribution at the surface produces an uneven plating. The workpiece is rotated over the fountains to compensate for the uneven ionic distribution produced by the fluid streams. This procedure requires the additional use of a motor and a control system for the workpiece rotation.

Unfortunately, practical and effective techniques for plating particulate materials are not readily available. Such particulate materials include the particle interconnect material described in DiFrancesco, Method For Cold Bonding, U.S. Pat. No. 4,804,132 and DiFrancesco, Particle-Enhanced Joining of Metal Surfaces, U.S. Pat. No. 5,083,697. Particle interconnect material contains coated metal particles, which are formed of diamond, silicon carbide particles coated by metals such as nickel or copper. These particles range in size from approximately 3 $\mu$m to approximately 200 $\mu$m. Particle interconnect material is typically used to pattern regions of thermal, electrical, and mechanical conductivity or insulation.

The particles can be dispersed in a binder, such as an adhesive, as described in DiFrancesco, Patternable Particle Filled Adhesive Matrix for Forming Patterned Structures Between Joined Surfaces, U.S. Pat. No. 5,670,251. Whether a particle settles or remains suspended in a plating fluid depends upon interdependent factors such as particle size, particle shape, and the relative density of the particle in a given density fluid.

Another significant factor is the fluid velocity local to each individual particle and to each location in the tank. Insufficient fluid velocity can cause particles to settle to the bottom rather than to remain suspended in the plating fluid. This frequently occurs along the sides of the plating tank. Faster particle settling generally occurs in slower, horizontally-flowing fluids, and for spherical and cylindrical particles. Larger particles, typically those in excess of 15 $\mu$m, tend to sink in the plating material. The smaller particles tend to remain in suspension in the plating fluid. This can be a significant problem in circulation plating systems.

The gas bubbles used in the prior art dip plating systems do not provide sufficient turbulence to support the larger particles in the fluid. Furthermore, while smaller particles can attach to the air bubbles and remain suspended, the larger particles cannot be so supported and settle to the bottom of the plating tank. In addition, the air bubbles reduce the density of the plating fluid, as previously discussed.

Similar problems are inherent to the fountain plating system. The fountain plating flow must achieve sufficient velocity to support the particles. However, the particle impact caused by a high velocity flow can result in surface damage.

The prior art plating systems are also not readily adapted to produce patterned plating. For example, when patterned over a surface, the previously described particle interconnect material can provide areas of electroconductivity and insulation. However, the ion deposition pattern is not readily controlled using the methods known in the prior art.

It would therefore be advantageous to provide a plating method and apparatus that increases the ionic exchange rate at the surface of a workpiece. It would be a further advantage if such method and apparatus provided a uniform deposition of plating materials over the workpiece surface. It would be yet another advantage if such method and apparatus were operable to deposit particulate materials such as particle interconnect. Additionally, it would be an advantage if such method and apparatus permitted the patterning of plated material on a workpiece surface.

SUMMARY OF THE INVENTION

The present invention provides a method and apparatus for momentum plating. The preferred embodiment of the present invention uses at least one tapered nozzle having a rectangular cross-section and having a rectangular slit aperture formed therein to direct a laminar jet flow of plating fluid to the surface of a workpiece. The jet flow contacts the workpiece surface at an angle of between approximately 10° to 85°, and preferably from approximately 70° to 85°.

The flow vector range of the laminar jet impinges on the surface in a continuous fashion and without interruption at a region to be plated. At this region, the flow vector closest to the surface is urged into contact with the surface by the other flow vectors of the jet. The momentum of the laminar jet flow pushes the depleted ions away from the surface of the workpiece. A high ionic exchange rate is thereby produced at the workpiece surface, with ionic exchange concentrated at the region to be plated.

The nozzle can be moved across the surface of a fixed-position workpiece to direct the jet of plating fluid to each consecutive region of the surface. Alternatively, the workpiece can be conveyed past a fixed nozzle. As the jet flow passes across the surface, the region to be plated moves correspondingly, and a uniform plated coating is formed over the workpiece.

In a first preferred embodiment of the invention, the nozzle is formed at least partially surrounding an anode. The anode can be formed of one or more anode elements or nuggets. Any or all of the anode elements can be consumable elements.

Prior to being ejected from the nozzle aperture as a jet flow, the plating fluid can first be passed through the anode and emitted through at least one aperture formed therein. Alternatively, the plating fluid flow can flow around the anode and then through the nozzle aperture.

In this first preferred embodiment, a first seal is provided between the nozzle and the workpiece. In one embodiment of the present invention, the first seal is positioned to prevent the plating fluid from flowing across an area of the workpiece that has not yet been plated. In an alternative embodiment, the first seal is positioned to prevent the plating fluid from flowing across a previously-plated area of the workpiece. The first seal is also operable to direct the jet flow across the surface of the workpiece, thereby maintaining the flow lines of the laminar fluid flow.

One or more additional seals may be provided at any side(s) of the jet to inhibit plating fluid from flowing from the surface of the workpiece An additional seal is operable to increase the length of time the plating fluid is in contact with the surface of the plating fluid. A first or additional seal can be used to remove chemistries from previous actions. The ionic exchange rate at the region to be plated is thereby increased.

The pattern of a plated coating is controlled by means including varying the number and orientation of any seals, the number of nozzles, the type of plating fluid, the angle of the jet flow, and the rate and direction of the jet flow across the surface of the workpiece. Such patterning includes but is not limited to producing different thicknesses, different layers, and plating only certain regions on the workpiece. Additionally, the present invention can pattern a plated coating across the surface. This patterned plated coating can include particulate materials, such as particle interconnect material.

In a second, equally preferred embodiment of the present invention, at least one nozzle for directing a jet of plating fluid is disposed in a dip plating tank. The nozzle(s) directs a jet of plating fluid to the surface of a workpiece that is at least partially immersed in the dip plating tank. The workpiece can optionally be conveyed through the tank and across the plating fluid jet(s) emitted from the nozzle(s).

In this second embodiment, an anode basket can be integrally formed as a part of the same element as the nozzle. For example, the nozzle can be joined to an adjacent anode basket, or can surround the anode, as described above. Alternatively, the anode basket can be formed as a separate element, adjacent and coplanar to the nozzle. A porous diffusion bag can optionally envelop the nozzle to distribute any non-uniform ion flows.

DETAILED DESCRIPTION OF THE INVENTION

The present invention provides a method and apparatus for momentum plating. The preferred embodiment of the present invention uses a nozzle arrangement to direct a laminar jet flow to the surface of a workpiece. A plating fluid is brought into contact with an anode at the highest velocity at which laminar fluid flow can be maintained. This promotes a rapid absorption of ions into the plating fluid because new ion-depleted plating fluid is constantly coming into contact with the anode. Similarly, the laminar jet of plating fluid can be directed to the workpiece surface at the highest velocity at which laminar flow can be maintained. The jet flow forces the ion-depleted plating solution away from the surface of the workpiece. The resulting high ionic exchange rate at the surface of the workpiece enhances the grain structure of the plating.

Figure 1:
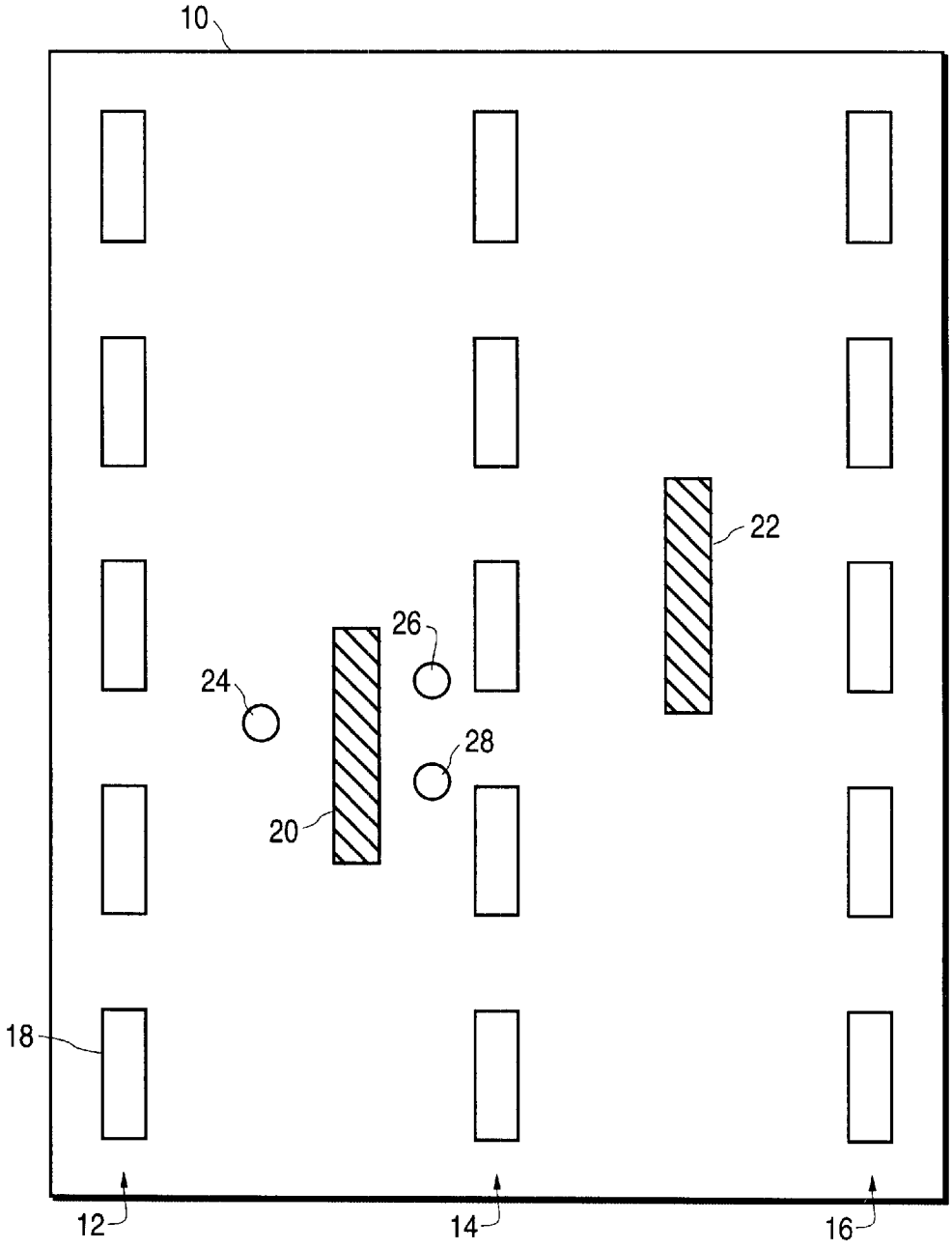
FIG.1 (PRIOR ART)
FIG. 1 is a top plan view of a dip tank plating system according to the prior art.
Figure 2:
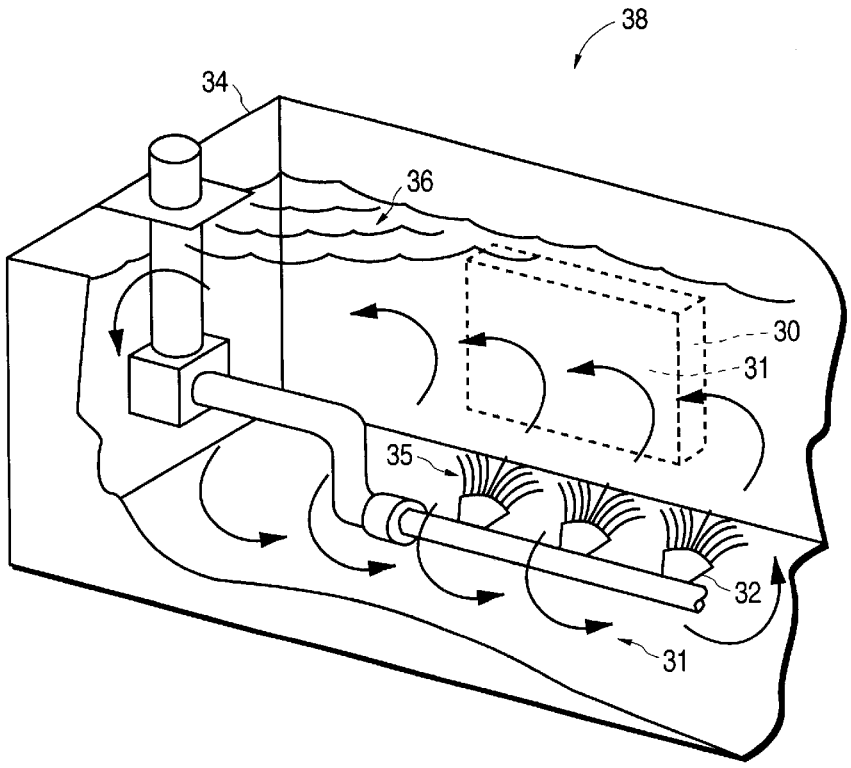
FIG.2 (PRIOR ART)
FIG. 2 is a top view of an circulation plating system according to the prior art.
Figure 3:
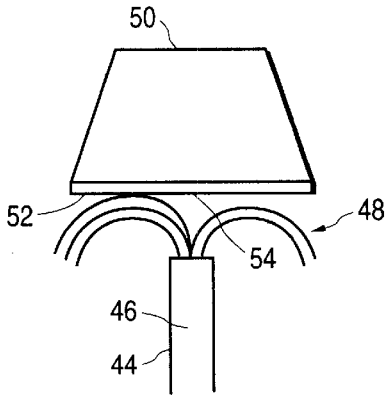
FIG.3 (PRIOR ART)
FIG. 3 is a side view of a portion of a fountain plating apparatus according to the prior art.
Figure 4:
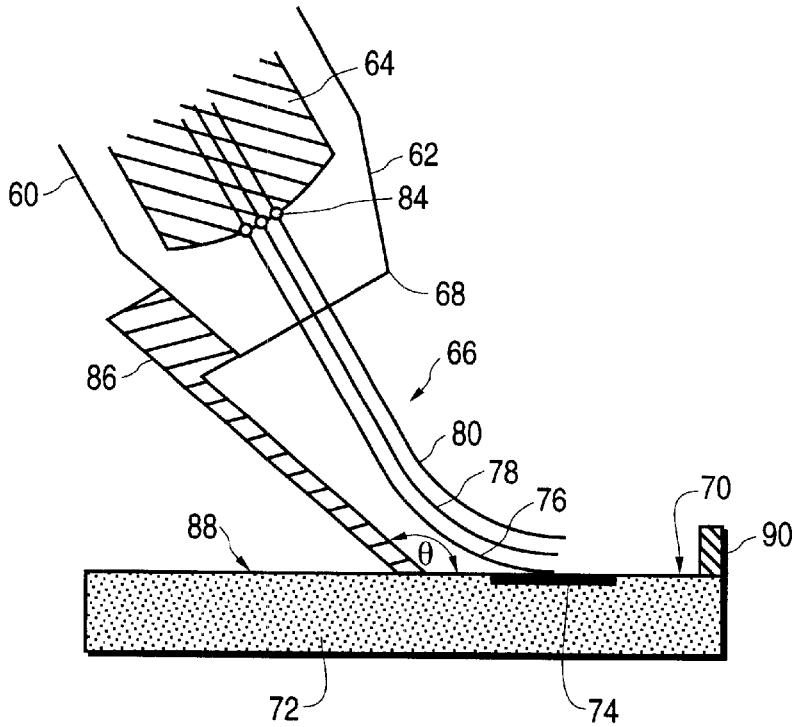
FIG. 4 is a side cross-sectional view of the momentum plating apparatus according to a first preferred embodiment of the present invention.

FIG. 4 is a side cross-sectional view of the momentum plating apparatus 60 according to a first preferred embodiment of the present invention. Nozzle 62 directs an angled non-turbulent jet 66 of a plating fluid to a surface 70 of the workpiece 72. The workpiece is preferably oriented either below or lateral to the jet.

The pressure causing the plating fluid jet is generated by any appropriate means including mechanical pumping, creating pressure with the weight of the water, and by restricting the nozzle aperture 68 diameter to increase the fluid flow velocity. This increased flow produces a higher ionic exchange rate at the surface of the workpiece. The rate and grain structure of the plating are thereby enhanced.

In the preferred embodiment of the present invention, the pressure causing the plating fluid jet is limited to that pressure necessary to form laminar flow. However, in an alternative embodiment of the invention, a turbulent jet flow can be directed at the surface of the workpiece. In this embodiment, the pressure causing the plating fluid jet is increased to that pressure necessary to form turbulent flow.

The nozzle restricts the plating fluid flow to create back pressure that forms laminar flow in the jet. A laminar flow is further promoted by the rectangular in cross-section tapered shape of the nozzle and the rectangular slit shape of the aperture. Any turbulence in the jet flow is smoothed out by the rectangular shape of the nozzle and a laminar jet is emitted through the rectangular aperture.

The rectangular slit aperture is also used to advantage because it produces a consistent and even plating across the workpiece. The rectangular slit does not produce a density gradient near the center or edges of the exposed surface area, nor does it produce the "dead spots" characteristic of the prior art.

In addition, the pipe conducting the plating fluid to the nozzle must be of sufficient length to permit any turbulent fluid flow to straighten itself out in the pipe. The upper rate of jet flow is restricted by the rate at which the jet flow becomes turbulent. The length of the pipe and upper rate of jet flow can be readily determined by one of ordinary skill in the art, using well-known fluid mechanics equations and design techniques.

The laminar jet flow contacts the surface at an angle $\theta$ of between approximately 10° to 85°, and preferably from approximately 70° to 85°. At such angles, the flow vector range of the laminar jet impinges on the surface in a continuous fashion and without interruption at a region to be plated 74. At this region, the flow vector 76 closest to the surface is urged into contact with the surface by the other flow vectors 78, 80 of the jet. The ionic exchange is thereby concentrated at the region to be plated.

However, fluid flow at angles substantially below 10° approaches a laminar flow that is parallel to the surface of the workpiece. A parallel flow contacts the surface at all points, and is subject to the effects of surface friction. Surface friction can create undesirable turbulent flow at some or all regions of the surface, and flows in this regime should be avoided.

Turbulent flow may also occur using a jet flow at angles substantially in excess of 85°. At such angles, the jet is directed back towards the first seal. Turbulence is then created when the jet flow strikes the first seal. Additionally, turbulence can be created when the fluid reflected from the jet's striking the first seal impinges on the jet flow from the nozzle.

In the present invention, the flow vector range of the jet impinges on the surface in a continuous fashion and without interruption, concentrating the ionic exchange at a region to be plated. As this jet flow moves across the surface of the workpiece, this region to be plated moves correspondingly. An even ionic disbursement can easily be created by moving the jet flow at a constant rate across the surface, thereby forming a consistent and uniform plated coating.

The nozzle can be moved across the surface of a fixed-position workpiece to direct the jet of plating fluid to each consecutive region of the surface. Alternatively, the workpiece can be conveyed past a fixed nozzle. As the jet flow passes across the surface, the region to be plated moves correspondingly, and a uniform plated coating is formed over the workpiece.

In a first preferred embodiment of the invention, the nozzle is formed surrounding an anode 64. The anode can be formed of any suitable material including platinum, and depolarized nickel sulfamate. Suitable anodes are the S-Rounds Electrolytic Nickel anode and Sulfur-Activated Nickel Anodes of International Nickel, Inc. or Saddle Brook, N.J. and the Harshaw Electropure Nickel Sulfamate anode manufactured by Adotech USA, Inc. of Somerset, N.J.

Furthermore, the anode can be formed of one or more anode elements or nuggets (not shown). Any or all of the anode elements can be consumable elements. The nozzle structure of the first preferred embodiment is used to advantage in the present invention because plating fluid having a constant concentration of ions is generated prior to the emission of the jet from the nozzle aperture.

Figure 5:
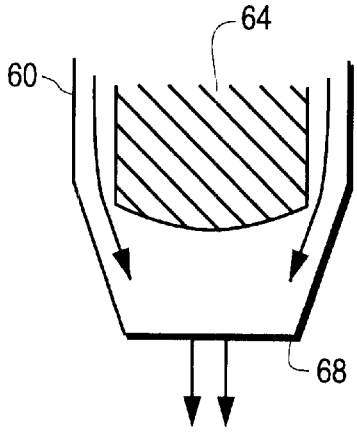
FIG. 5 is a side cross-sectional view of a nozzle according to an alternative embodiment of the present invention.

Prior to being ejected from the nozzle aperture 68 as a jet flow, the plating fluid can first be passed through the anode and emitted through at least one aperture 84 formed therein. Alternatively, as illustrated by FIG. 5, the plating fluid flow can flow around the anode 64 and then through the nozzle aperture 68.

In this first preferred embodiment, a first seal 86 is provided between the nozzle and the workpiece. This first seal is joined to the nozzle and extends from the nozzle to the surface of the workpiece. In one embodiment, the first seal is positioned to prevent the plating fluid from flowing across an area 88 of the workpiece surface that has not yet been plated. In an alternative embodiment, the first seal is positioned to prevent the plating fluid from flowing across a previously-plated area of the workpiece (not shown).

The nozzle can optionally be adapted for bi-directional movement across the workpiece surface. In this embodiment, the first seal alternately prevents the plating fluid from flowing across pre-plating and post-plating areas of the surface.

The first seal directs the laminar jet flow forward across the surface. The laminar flow vector that is closest to the surface is urged into contact with the surface by the other flow vectors of the jet at the region to be plated 74, directly in front of the first seal. The flow lines of the non-turbulent fluid flow are thereby maintained.

One or more additional seals 90 may be provided at any of the edges of the workpiece to inhibit plating fluid from flowing from the surface. For example, a second seal can be positioned at an edge of the workpiece that is downstream from the plating fluid flow. An additional seal(s) is operable to increase the length of time the plating fluid is in contact with the surface of the plating fluid. The ionic exchange rate at the region to be plated is thereby increased.

Furthermore, an additional seal can be used to remove chemistries from previous actions. For example, an additional seal can be used to wipe or swab the surface clean from microetching chemistries, and then to remove any excess cleansing solution or water used to clean the surface. An additional seal can also be used to create a narrow or wider track through which the nozzle passes. Such an additional seal can be attached to any appropriate portion of the system, including the nozzle, the sides of the plating tank, an anode basket, or to side rails positioned facing the surface(s) of the plating piece.

The first seal and any additional seals are preferably formed of a flexible material, such as polyurethane, silicone, or rubber. A suitable material is manufactured by E. I. du Pont de Nemours and Company of Wilmington, Del.

A plurality of nozzles may be directed either simultaneously or sequentially at the surface of the workpiece (not shown). One or more nozzles according to the present invention can be used in conjunction with any number any number and type of prior art nozzles.

Where a plurality of nozzles is sequentially directed to the workpiece surface, each nozzle can emit a different plating fluid, according to the requirements of the particular plating process. For example, a first nozzle can direct a jet to coat the surface with a non-particulate metal coating. A second jet can then coat this metal coating with an adhesive particle interconnect material, such as the materials described in U.S. Pat. Nos. 4,804,132 and 5,083,697, discussed above.

Additionally, the present invention can pattern a plated coating across the surface. This plated coating can include particulate materials, such as particle interconnect material. Such patterned plating is described in DiFrancesco, U.S. Pat. No. 5,670,251, discussed previously.

A patterned plating on the workpiece surface can be provided by configuring the locations of the nozzles and the contents of their respective plating fluids. The pattern of a plated coating is controlled by techniques including varying the number and orientation of any seals, the type of plating fluid, the angle of the jet flow, and the rate and direction of the jet flow across the surface of the workpiece. Such patterning includes but is not limited to producing different thicknesses, different layers, and plating only certain regions on the workpiece surface.

The patterning can also be controlled by varying the number and orientation of nozzles. A plurality of nozzles can be used to advantage in increasing the quality and throughput of a plating process. For example, in a typical plating process, a plated coating is first applied and then rinsed one or more times. An anti-tarnishing solution can also be applied. In the multiple nozzle embodiment of the present invention, separate nozzles can be used to sequentially apply the plating fluid, rinsing solutions, and anti-tarnishing solution.

Figure 6:
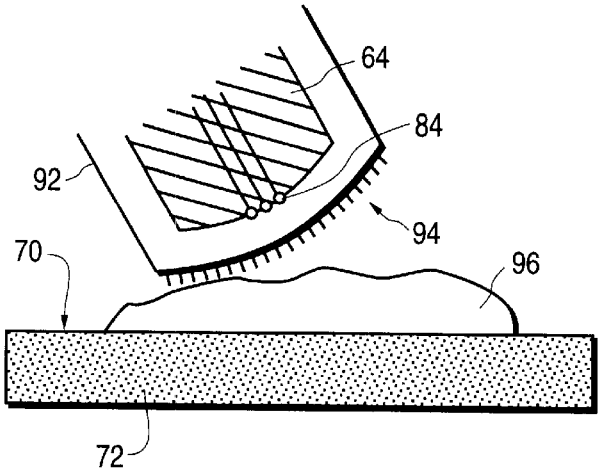
FIG. 6 is a side cross-sectional view of a non-momentum flow anode according to the present invention.

The present invention can optionally include one or more anodes that are adapted for non-momentum flow. FIG. 6 is a side cross-sectional view of a non-momentum flow anode according to the present invention. In the Figure, a non-momentum fluid flow is emitted from apertures 84 in the anode 64. A porous anodic bag 92 surrounds the anode 64. The porous anodic bag disperses the fluid flow 94. As the fluid contacts the workpiece surface 70, the fluid velocity is reduced. As a result, fluid accumulates 96 at the surface.

Such non-momentum flow anode can be used to smooth momentum-plated surfaces. Plating fluid emitted from a non-momentum flow anode plates the surface at a slower rate than momentum flow plating. The non-momentum flow anodes can be used in a secondary pulse plating or slow plating technique to round sharp corners and smooth any irregularities produced by the primary momentum plating technique.

In addition, such non-momentum flow "anode" can be used in a reverse plating system in which it functions as a "cathode" relative to the workpiece. This reverse plating system can be used to electropolish the workpiece surface.

Figure 7:
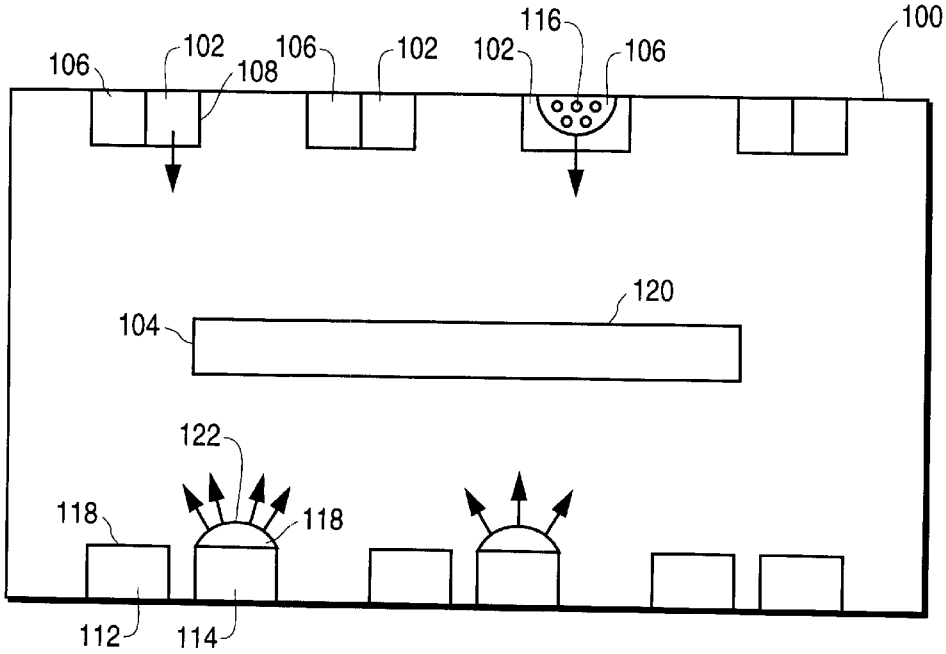
FIG. 7 is a top view of a momentum dip plating tank, according to a second embodiment of the present invention.

In a second, equally preferred embodiment of the present invention, at least one nozzle for directing a jet of plating fluid is disposed in a dip plating tank. FIG. 7 is a top view of a momentum dip plating tank 100, according to a second embodiment of the invention. A plurality of momentum plating nozzles 102 are disposed on either side of the plating tank. A nozzle can optionally be provided with one or more seals for inhibiting the flow of the plating fluid over the surface of the workpiece, as has been previously described. The workpiece/cathode 104 is placed into the tank, between the opposing nozzles, such that a surface to be plated 120 is at least partially immersed in a plating fluid (not shown) contained in the tank.

The nozzle(s) directs a jet of plating fluid to the workpiece to plate the surface. Momentum is imparted to the jet of plating fluid by means including a pump. The momentum of the jet sweeps some or all of the ion-depleted plating fluid away from the workpiece surface. The plating fluid is thereby continually refreshed, and increased ionic exchange is promoted at the workpiece surface.

The workpiece can be left in a stationary position in the plating fluid until the plating process is completed.

Alternatively, the workpiece can be conveyed through the plating tank and across the plating fluid jet(s) emitted from the nozzle(s). A high throughput of plated workpieces having uniform plated coatings can thereby be achieved.

In this second embodiment, an anode basket 106 is formed as a part of the same element 108 as the nozzle 102. For example, the nozzle can be joined to an adjacent anode basket to form this element (see element number 108).

The nozzle also surround or partially surround 110 the anode, as described above with respect to the first preferred embodiment. For example, in the Figure, an anode basket 106 includes anodic nuggets 116 disposed within a nozzle 102. Such nuggets are formed of the previously-described anodic materials. Alternatively, the anode basket can be formed as a separate element 112, adjacent to a non-attached nozzle 114. In this embodiment, both anode basket and nozzle have coplanar anterior surfaces 118.

A porous bag 122, for example, made of a cloth or fabric, can also be placed over a nozzle. The bag finely screens the plating fluid to prevent coarse particles from contacting the workpiece surface. The bag also creates a slight back pressure between the face of the nozzle and the back side of the bag. As a result, the bag acts as a very fine diffusing nozzle to distribute any non-uniform ionic concentrations within the jet flow. In this embodiment, the workpiece can be conveyed past the bagged nozzle to be rapidly and uniformly plated.

While the present invention has been described in terms of a preferred embodiment above, those skilled in the art will readily appreciate that numerous modifications, substitutions and additions may be made to the disclosed embodiment without departing from the spirit and scope of the present invention. For example, an anode, such as an anodic nugget or anode basket can have any shape operable to produce the appropriate ionic concentration in the plating fluid. Additionally, one or more nozzles according to the present invention can be used in conjunction with any number of prior art nozzles to plate a substrate.

Furthermore, although the momentum plating apparatus and method has been described above for use with an electrochemical plating system, those skilled in the art will readily appreciate that the present invention can be used in other chemical systems. For example, momentum plating according to the present invention can be used with electroless plating and cleaning processes. No anode is required for such electroless plating and cleaning processes. Electroless plating requires a controlled rate of fluid flow, to minimize interruption to the chemical process. The present invention permits a rapid ionic exchange at the surface, and sweeps away ion-depleted electroless plating fluid.

Momentum plating according to the present invention can also be used to condition the metal surfaces using microetching chemistries and black oxide. Acid soap chemistries can be used to momentum-clean a surface, for example, to clean off fingerprints. The present invention can additionally be used to apply anti-tarnishing chemistries to a workpiece surface.

In one embodiment, the present invention uses a fluid that contains particles to mechanically clean a surface. For example, a stainless steel surface can be momentum-cleaned using non-metal coated particles. The momentum of the fluid improves the cleaning of the surface.

The invention can also be used in the process of forming bumps on semiconductor die, as discussed in DiFrancesco, Electrical Interconnect Using Particle Enhanced Joining of Metal Surfaces, U.S. Pat. No. 5,642,055.

Similarly, the skilled artisan will readily appreciate that the present invention is in no way limited to use with a particular type of plating system or a particular plating apparatus or plating tank. Those skilled in the art will also readily appreciate that the momentum plating apparatus and system may be used with any similar plating mechanism. It is intended that all such modifications, substitutions and additions fall within the scope of the present invention, which is best, defined by the claims below.

What is claimed is:

1. An apparatus for momentum plating a workpiece, comprising:

at least one anode; and a tapered nozzle having a rectangular cross-section that at least partially surrounds the anode and defines a flow path between the nozzle and the anode for directing a jet of a plating fluid to a surface of the workpiece, the nozzle being positioned relative to the workpiece such that a laminar flow of plating fluid from the nozzle contacts the workpiece surface at an angle of between about 10° and 85°;

wherein the workpiece is adapted to be the cathode.

2. The apparatus of claim 1, wherein the anode has at least one rectangular aperture formed therethrough for emitting the plating fluid into the nozzle.

3. The apparatus of claim 1, wherein the plating fluid flows around the at least one anode and through the nozzle.

4. The apparatus of claim 1, wherein the at least one anode is a consumable anode.

5. The apparatus of claim 1, wherein the momentum plating apparatus is movable across the surface of the workpiece.

6. The apparatus of claim 1, wherein the surface of the workpiece is oriented either below or lateral to the jet of plating fluid emitted from the at least one nozzle.

7. The apparatus of claim 1, further comprising at least a first seal between the nozzle and the workpiece surface for preventing the plating fluid emitted from the nozzle from flowing across a previously-plated area of the workpiece surface.

8. The apparatus of claim 7, further comprising at least a second seal for inhibiting the plating fluid emitted from the nozzle from flowing away from the surface of the workpiece.

9. The apparatus of claim 1, wherein the laminar flow of plating fluid contacts the workpiece surface at an angle of between about 70° to 85°.

10. An apparatus for momentum plating a workpiece, comprising:

at least one anode; and a nozzle surrounding the anode that defines a flow path between the nozzle and the anode for directing a jet of a plating fluid to a surface of the workpiece;

wherein the anode has at least one aperture formed therethrough for emitting the plating fluid into the nozzle;

wherein the plating fluid contacts the surface at an angle of between 10° and 85°.

11. The apparatus of claim 10, wherein at least one anode is a sacrificial anode.

12. The apparatus of claim 10, wherein the momentum plating apparatus is movable across the surface of the workpiece.

13. The apparatus of claim 10, wherein the surface of the workpiece is oriented either below or lateral to the jet.

14. The apparatus of claim 10, further comprising at least a first seal between the nozzle and the workpiece for preventing the plating fluid from flowing across a previously-plated area of the workpiece.

15. The apparatus of claim 14, further comprising at least a second seal for inhibiting the plating fluid from flowing away from the surface of the workpiece.

16. The apparatus of claim 15, wherein the laminar flow of plating fluid contacts the workpiece surface at an angle of between about 70° to 85°.

17. An apparatus for momentum plating a workpiece, comprising: at least one anode; and a nozzle surrounding the anode that defines a flow path between the nozzle and the anode for directing a jet of a plating fluid to a surface of the workpiece;

wherein the plating fluid flows around the anode and through the nozzle;

wherein the plating fluid contacts the surface at an angle of between 10° and 85°.

18. The apparatus of claim 17, wherein at least one anode is a sacrificial anode.

19. The apparatus of claim 17, wherein the momentum plating apparatus is movable across the surface of the workpiece.

20. The apparatus of claim 17, wherein the surface of the workpiece is oriented either below or lateral to the jet.

21. The apparatus of claim 17, further comprising at least a first seal between the nozzle and the workpiece for preventing the plating fluid from flowing across a previously-plated area of the workpiece.

22. The apparatus of claim 21, further comprising at least a second seal for inhibiting the plating fluid from flowing away from the surface of the workpiece.

23. The apparatus of claim 22, wherein the laminar flow of plating fluid contacts the workpiece surface at an angle of between about 70° to 85°.

* * * * *